US005533577A

United States Patent [19]

Jucker

[11] Patent Number: 5,533,577

[45] Date of Patent: Jul. 9, 1996

[54] MAINTENANCE VEHICLE FOR SERVICING A SPORTS FACILITY, AND A METHOD OF USING THE MAINTENANCE VEHICLE

[76] Inventor: John Jucker, Seestrasse 289, CH-8810 Horgen, Switzerland

[21] Appl. No.: 255,227

[22] Filed: Jun. 7, 1994

[30] Foreign Application Priority Data

Dec. 10, 1993 [CH] Switzerland ..... 03683/93

[51] Int. Cl.[6] ..... A01B 45/00

[52] U.S. Cl. ..... 172/21; 34/71; 15/98

[58] Field of Search ..... 37/209, 211, 905, 37/227, 317; 172/21, 29, 133; 171/58; 15/98, 340.1, 353, 345, 346; 34/92, 397, 399, 69, 70, 71; 56/1, 2, DIG. 22

[56] References Cited

U.S. PATENT DOCUMENTS

| | | | |
|---|---|---|---|
| 2,706,863 | 4/1955 | Jones | 15/98 X |
| 3,079,620 | 3/1963 | Hunter | 15/98 X |
| 3,187,821 | 6/1965 | Kamlukin | 56/DIG. 22 X |
| 3,439,747 | 4/1969 | Kindlien et al. | 172/21 |
| 3,683,447 | 8/1972 | Stevenson | 15/320 X |
| 3,736,619 | 6/1973 | Zamboni | 15/340.1 |
| 3,902,219 | 9/1975 | Jones | 15/340.1 X |
| 3,950,812 | 4/1976 | Mohr | 15/98 |
| 3,967,339 | 7/1976 | Newman | 15/98 X |
| 4,219,329 | 8/1980 | Celanza | 433/58 |
| 4,226,034 | 10/1980 | Benjamin et al. | 15/340.1 X |
| 4,345,544 | 8/1982 | Besecker | 118/108 |
| 4,356,584 | 11/1982 | Zamboni | 15/98 |
| 4,483,034 | 11/1984 | Andersson | 15/98 |
| 4,542,594 | 9/1985 | McLaughlin | 34/71 |
| 4,570,367 | 2/1986 | Oya | 37/232 |
| 4,571,849 | 2/1986 | Gardner et al. | 15/346 X |
| 4,839,061 | 6/1989 | Manchak, Jr. et al. | 37/232 X |
| 4,879,820 | 11/1989 | McLaughlin | 34/71 |
| 4,989,293 | 2/1991 | Bashyam | 15/98 X |
| 5,036,655 | 8/1991 | Holloway | 172/21 X |
| 5,115,579 | 5/1992 | Pappas | 34/71 X |

OTHER PUBLICATIONS

Liljedahl et al., Tractors and Their Power Units, ©1979 John Wiley & Sons, Inc., pp. 12 & 13.

*Primary Examiner*—Terry Lee Melius
*Assistant Examiner*—Victor Batson
*Attorney, Agent, or Firm*—Flynn, Thiel, Boutell & Tanis

[57] ABSTRACT

A maintenance vehicle with a suction roller constructed as a water-removing device is used for preparing, for the purpose of achieving an optimum condition, a natural grass playing field for soccer games or the like. This suction roller is essentially a perforated drum-shaped roller with a foam-rubber coating surrounding it. A weight roller lies approximately on top on the suction roller and is rotatably supported axially parallel to same, and a catching trough is positioned in the suction roller with a pipeline leading into a water tank for the purpose of emptying the trough. This maintenance vehicle also has a lawn verticulator, a surface roller, and a warm-air blower for drying or aerating the playing field. Thus, it is possible to remove accumulating rain water on a playing field within the shortest possible time, so that soccer games can take place independently of the respective weather conditions and the terrain can be maintained in an optimum condition.

13 Claims, 3 Drawing Sheets

MAINTENANCE VEHICLE FOR SERVICING A SPORTS FACILITY, AND A METHOD OF USING THE MAINTENANCE VEHICLE

FIELD OF THE INVENTION

The invention relates to a maintenance vehicle for servicing a sports facility and a method of using the vehicle, the maintenance vehicle having at least one water-receiving device which can be switched on.

BACKGROUND OF THE INVENTION

It is important for large sporting events, in particular for soccer games, that the fields are vacuumed shortly before the start of a game, because heavy rains can have the result that the playing fields, which are in an open stadium, become flooded and the drains installed in the field are no longer able to absorb the water and thus the field has standing water, at least in some locations. Soccer games are often played regardless of the conditions, which means they are often not played under normal playing conditions. It can be very expensive for an organizing club to postpone a game shortly before its start, or to stop a game after it had started and deal with angry spectators.

A basic purpose of the present invention is therefore to prepare a field of grass in such a manner so that soccer games or other events can be played under any type of weather conditions on the field, and that moreover at the same time a careful maintenance of the sensitive grass becomes possible.

SUMMARY OF THE INVENTION

This purpose is attained according to a method of invention by using a maintenance vehicle with a water-receiving device for the preparation of a natural grass playing field, for soccer games or the like.

A maintenance vehicle of the invention has a water-receiving device and preferably a lawn aerator, a surface roller and a warm-air blower.

By using the maintenance vehicle of the invention, it is possible to play all planned soccer games in the future under practically any weather conditions, and it can thus be avoided that games must be cancelled at the last minute, that spectators travel to a game needlessly, and that unnecessary expenses for an organizing club are created.

BRIEF DESCRIPTION OF THE DRAWINGS

Further possibilities for equipment and design of the vehicle of the invention, and also further advantages of the same, are discussed in greater detail hereinafter in connection with the drawings, in which.

DETAILED DESCRIPTION

Figure 1:
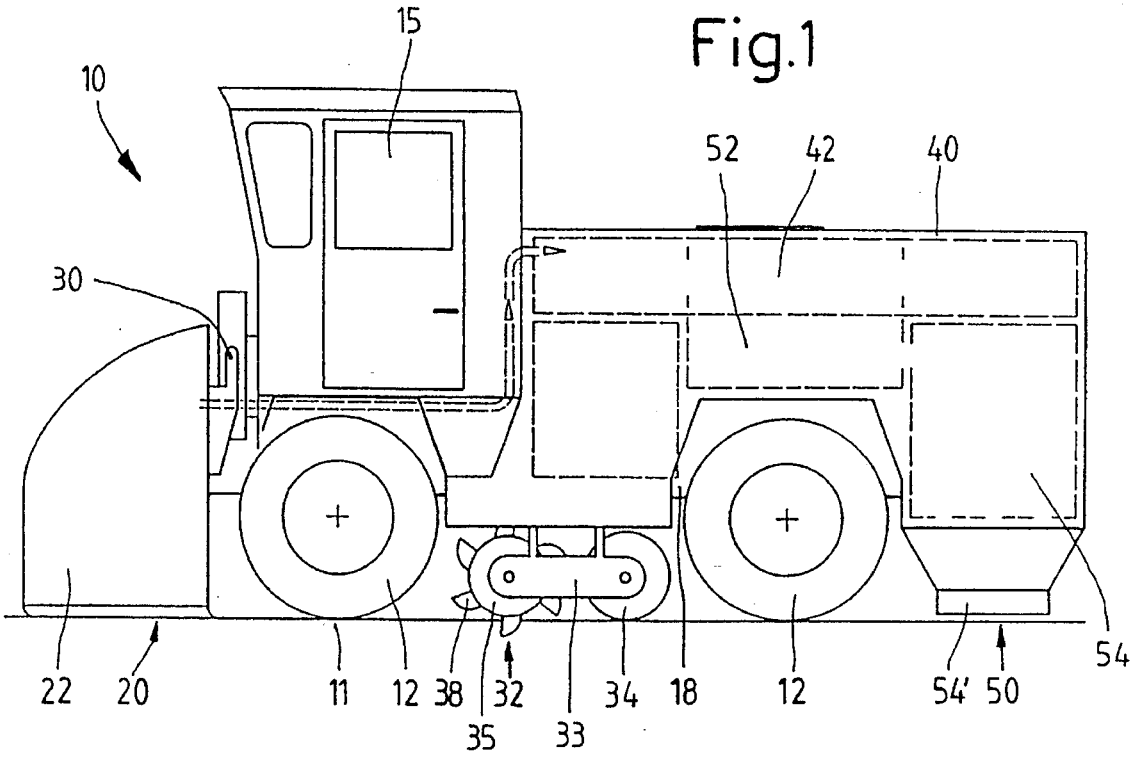
FIG. 1 is a diagrammatic side view of a first embodiment of a maintenance vehicle according to the invention.

FIG. 1 shows a maintenance vehicle 10 according to the invention, which includes an underframe 18, a driver's cab 15, a utility portion 40, four wheels 12, and various utility devices which will be described hereinafter.

A water-sucking vacuum or water-collecting device 20 of the invention, is removably fastened on a carrier 30, which is elevationally adjustable and is arranged on a front end of the vehicle 10. It has a suction part 22 directly above a playing field 11, and has directly communicating with the suction part 22 a water tank 42 into which the sucked-up water is emptied. The suction part 22 preferably extends approximately the full vehicle width. A suction motor, which is not shown in detail and which is preferably integrated into the utility portion 40, causes through slotlike or round suction nozzles, which are in suction part 22 and are not illustrated in detail, a conventional vacuuming action. The suction nozzles, which are positioned directly above the grass, are evenly distributed over the entire width in the suction part 22 so that an optimum vacuuming up of the water occurs with these nozzles.

The maintenance vehicle 10 is designed with an efficient performance so that accumulating rain waters can be removed within the shortest time period from a playing field with the vehicle. This, of course, depends on the amount of water, and may take between 30 and 120 minutes. This maintenance vehicle 10 is therefore especially suited for use directly before the start of a game or during an interruption in the game, and it can be used, for example, during a heavy rainfall during the game, prior to and during an official break.

Figure 3:
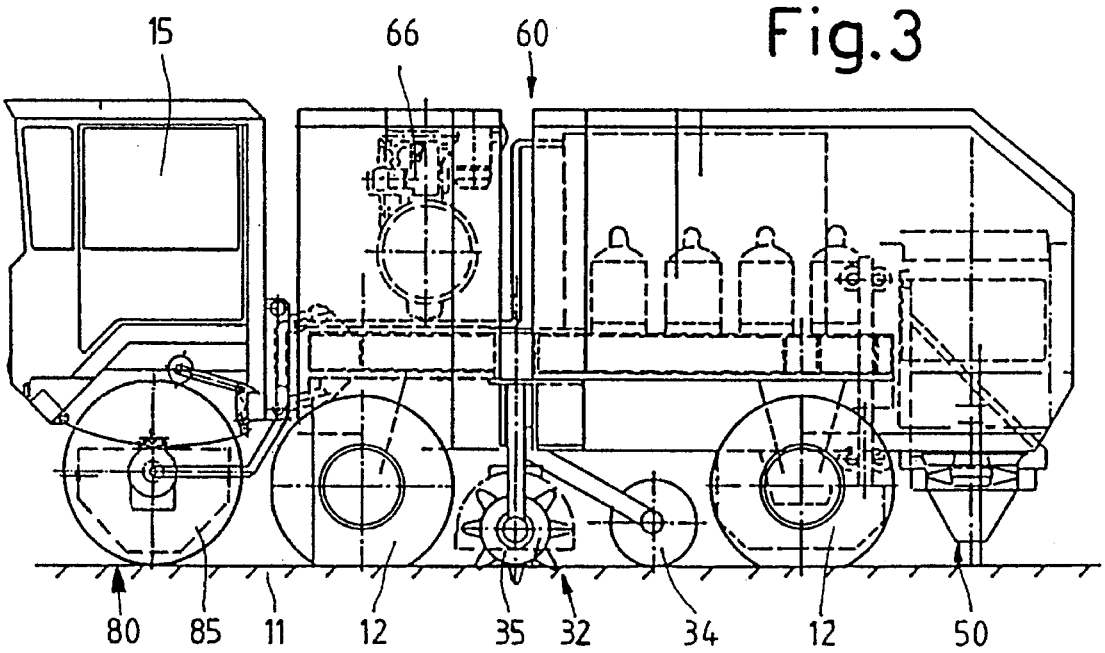
FIG. 3 is a diagrammatic side view of a second embodiment of the maintenance vehicle according to the invention.

The maintenance vehicle 10 preferably has a lawn aerator 32, a surface roller 34 and a warm-air blower 50. The lawn aerator is a device which produces small grooves or rows of openings in a lawn to improve its aeration and prevent the growth of moss and is oriented, as shown in FIGS. 1 and 3, behind the water-collecting device 20 oriented on the front end of the vehicle frame or chassis 18. A number of discs or sprocket wheels are arranged for free rotation on an axle or for rotation with such axle. When pressed into a lawn and moved in a direction perpendicular to the axle, they produce grooves or openings in the lawn. Any residual water on the surface of the ground after water has been collected from the ground by the water-collecting device 20 will enter the grooves or rows of openings to leave the grass blades free of contact with the residual water. The lawn aerator 32 and the surface roller 34 are arranged below the vehicle 10 between the wheels 12, and are rotatably supported in a hydraulically elevationally adjustable mounting 33. In FIG. 1, they are shown pressed by the mounting 33 onto the ground. The lawn aerator 32 has a slotted roller 35 rotated by a drive, which slotted roller 35 has knifelike blades 38 that penetrate into the ground and effect an aeration of same in a conventional manner and to simultaneously create places beneath the upper surface of the ground for any residual water to go thereby leaving the grass blades free of contact with the residual water to thereby enhance a drying of the grass blades. This slotted roller 35 and the surface roller 34 arranged parallel thereto extend approximately the full width of the vehicle, and rotate during the movement of the vehicle. The roller 34 evens out irregularities in the ground. When these two devices are not in use, they can be vertically lifted away from the ground through a conventional lifting mechanism which is not illustrated in detail.

The warm-air blower 50 is arranged in a rear area of the vehicle 10 and includes an air-heating system 52 and a warm-air fan 54, from which warm air flows out of a fan outlet opening 54' directed toward the ground and thus causes the field of grass to dry. This opening 54' preferably extends the full width of the vehicle.

This warm-air blower 50 contributes to being able to bring a soccer field, within the shortest possible time, into an optimum condition. In addition, it can melt snow or ice, and can thus instantaneously produce a snow-free and almost dry field. Attention must thereby be paid to the air-heating system 50 to ensure the warm air has a temperature so that the grass is not damaged by burns.

Figure 2:
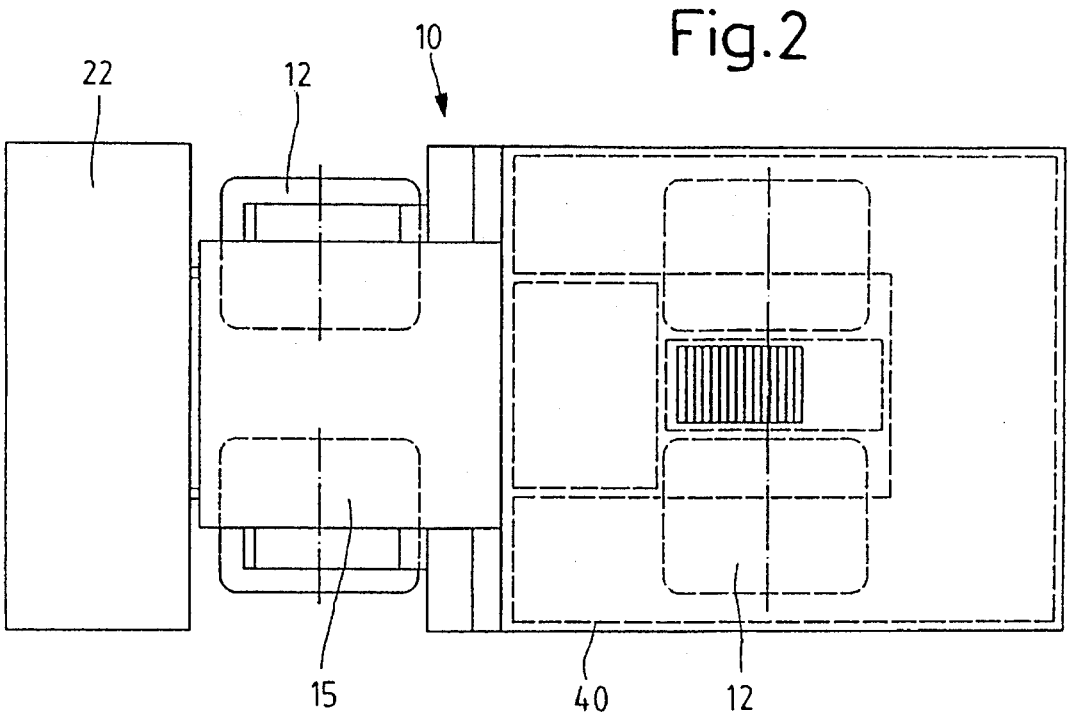
FIG. 2 is a diagrammatic top view of the vehicle according to FIG. 1.

The four wheels 12 of the vehicle 10 are individually driven through differentials, and have tire widths without a tread, the tires having, for example, a width of between 0.30 and 0.80 meter, as shown in FIG. 2. The weight per unit of area which is applied by these wheels 12 onto the playing field 11 is advantageously chosen so that it does not exceed the weight per unit of area of a normal person.

In place of the water-sucking vacuum 20 removably supported on the carrier 30, it is possible to fasten on the carrier 30 a sprinkling system for sprinkling the field, a mowing device for mowing the field, or a snow plow. It is also possible to mount a sand or seed sprayer at the rear of the vehicle. Also, it is possible to provide a device in the vehicle, by means of which the lines of the playing field could be marked. From this results a universal usability of this vehicle 10. It moreover has a conventional motor, which is, for example, preferably fueled by propane gas. To operate the liftable carrier 30 and also the mounting 33, a hydraulic system must be provided, which like the motor is not shown in detail but is of a conventional type.

Figure 4:
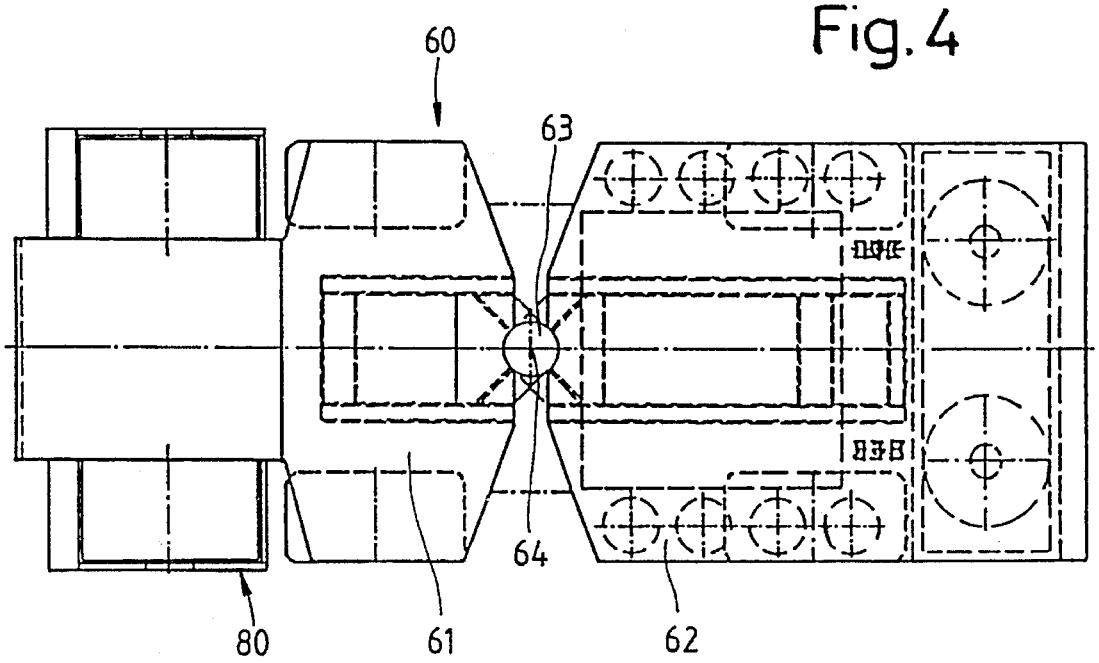
FIG. 4 is a diagrammatic top view of the vehicle according to FIG. 3.

FIG. 3 shows a vehicle 60 which is an alternative embodiment of the invention. The vehicle 60 is designed similar to the vehicle according to FIG. 1, in that it has a lawn aerator 32, a surface roller 34, and a warm-air blower 50. Furthermore, a conventional motor 66 is integrated into a front part of the vehicle 60. Only the differences will be discussed hereinafter. A two-part underframe 61–62 of the vehicle 60 is shown in FIG. 4, in which the two underframe parts 61 and 62 are held together by a joint connection 63. This joint connection 63 forms a pivot axis extending perpendicular to the ground of the playing field 11, and enables a limited swivelling movement of the front part 61 relative to the rear part 62. This improves the turning capability of the vehicle 60 and thus protects the field surface, in particular when a suction roller 80 designed as a water-receiving device is being used.

Figure 5:
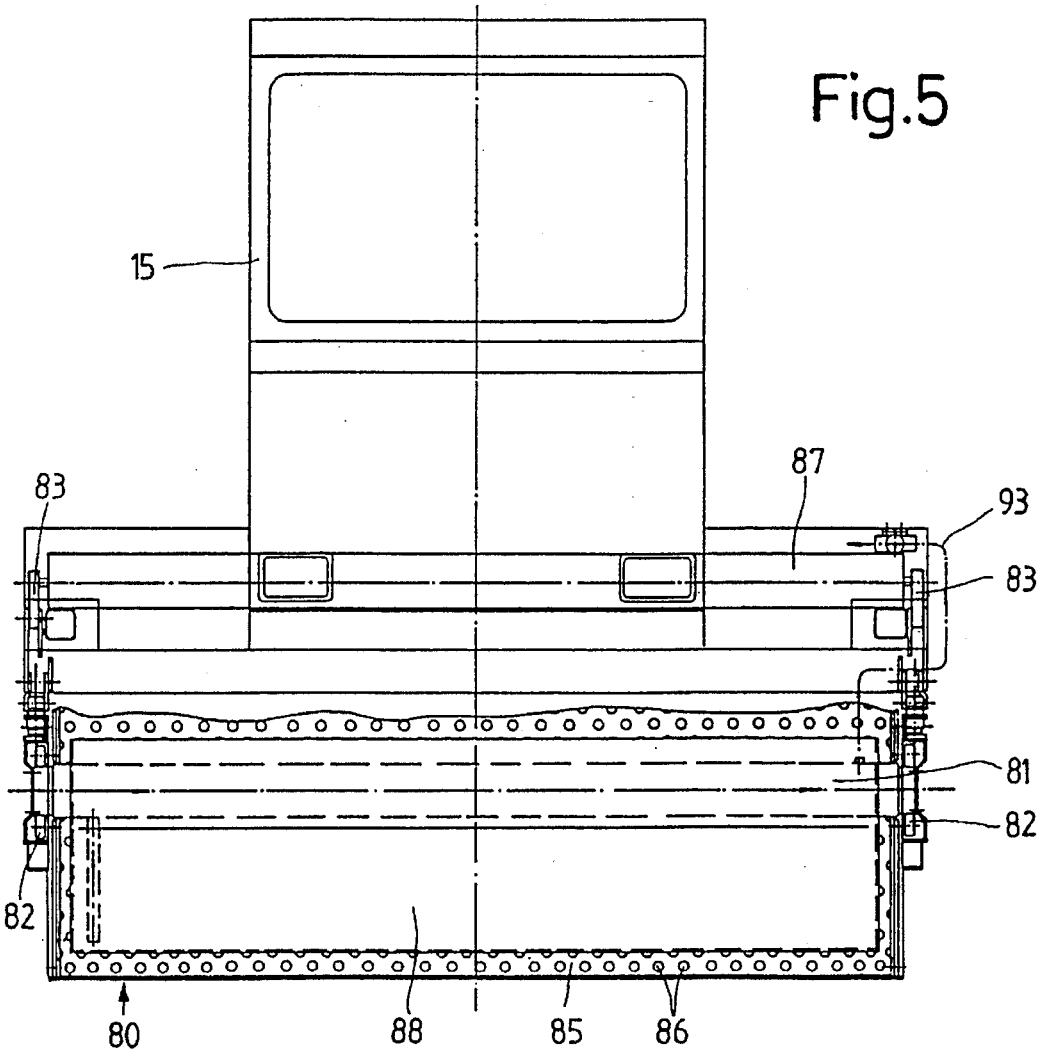
FIG. 5 is a diagrammatic front view of the vehicle according to FIG. 3, with a suction roller thereof being shown partially in cross section.
Figure 6:
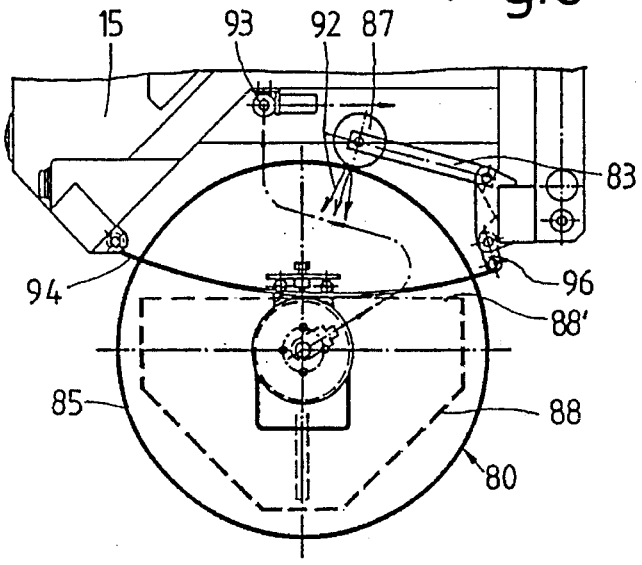
FIG. 6 is a diagrammatic partial side view of the vehicle according to FIG. 3.
Figure 7:
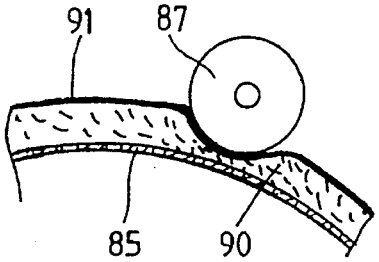
FIG. 7 is an enlarged diagrammatic sectional side view of part of the suction roller of FIG. 5.

The suction roller 80 of the invention, which is designed as a water-receiving device, includes according to FIGS. 5 to 7, an essentially drum-shaped roller 85 with a foam-rubber coating 90, a rotatable weight roller 87 arranged axially parallel to the roller 85 and lying on same, an axle 81 rotatably supporting the roller 85 through hubs 82, and a stationary catching trough 88 held by the axle and having an opening 88' which extends within the roller 85 approximately its entire length and which has a width corresponding approximately to the inside diameter of the roller. The opening 88' is thereby preferably located above the axis of rotation of the roller 85 in a horizontal alignment, and the base of the trough 88 is arranged directly above the lower curvature of the roller 85.

The axle 81 and thus also the roller 85 are supported on each side by a respective leaf spring 94 arranged transversely on the underside of the vehicle cab 15, with which leaf spring the roller 85 is pressed with a spring action against the ground of the playing field and can even out irregularities in the ground. These leaf springs 94 are for this purpose each hingedly supported by a lever 96 at one end to permit their longitudinal expansion. The drum-shaped roller 85 is perforated and has therefore holes 86 distributed over its entire outer surface. The foam-rubber coating 90 in turn is covered with a netlike textile skin 91 and is thus protected. The weight roller 87 extends approximately the entire length of the roller 85, and is rotatably supported at each end on a respective lever 83 pivotally supported on the vehicle 60. The weight roller 87 presses with its own weight onto the foam-rubber coating 90, which in the present exemplary embodiment has a thickness of approximately 4 centimeters, but could also be thicker or thinner. The weight of the weight roller 87 and the consistency of the foam rubber 90 are adjusted to one another so that the water soaked off from the ground during rotation of the roller 85 is pressed out by the roller 87 in an optimal manner. The water 92 pressed out on the upper side of the roller 85 falls, due to the force of gravity, through the holes 86 and into the catching trough 88. For the purpose of emptying the trough 88, the water 92 is pumped by a conventional pump (not illustrated) through a line 93 shown in dash-dotted lines into a water tank housed in the vehicle 60. Thus, it is possible to very quickly soak up and collect a large amount of water.

The invention could of course be explained using other exemplary embodiments. However, it is sufficiently explained with the described embodiments.

By using such a vehicle 10 or 60, cancellation or stopping of games due to rain can be extensively prevented with the respective water-receiving device. In addition by using this vehicle 10, the best possible conditions for fair games without fortuitous influences can be realized.

Although two preferred embodiments of the invention have been disclosed in detail for illustrative purposes, it will be recognized that variations or modifications of the disclosed embodiments, including the rearrangement of parts, lie within the scope of the present invention.

The embodiments of the invention in which an exclusive property or privilege is claimed are defined as follows:

1. A maintenance vehicle for removing water from a natural sports grass playing field of a sports facility, comprising in combination:

a) a wheeled vehicle having a frame;

b) a water-collecting device mounted on said frame for removing water from the surface of the playing field;

c) a mechanical aerator means mounted on said frame a finite distance from said water-collecting device for aerating and loosening the portion of the ground from which water has been removed by creating small grooves or rows of openings in the surface of the ground to cause any residual water on the ground to enter the grooves or rows of openings to orient the surface of the water below an upper surface of the ground so that grass blades above the surface of the ground will be free of contact with the residual water to thereby enhance a drying of the grass blades; and d) means for independently adjustably moving said mechanical aerator means and said water-collecting device toward and away from the surface of the ground.

2. The maintenance vehicle according to claim 1, further comprising a surface roller mounted a finite distance from said aerator on said vehicle frame and on a side of said mechanical aerator means remote from said water-collecting device.

3. The maintenance vehicle according to claim 2, further comprising a warm-air blower with downwardly directed outlets mounted on said vehicle frame for directing an air flow downwardly toward the ground and into intimate contact with the grass blades to thereby enhance the drying of the grass blades, said warm-air blower being located on the vehicle frame on a side of said surface roller remote from said mechanical aerator means.

4. The maintenance vehicle according to claim 1, further comprising a warm-air blower with downwardly directed outlets mounted on said vehicle frame for directing an air flow downwardly toward the ground and into intimate contact with the grass blades to thereby enhance the drying of the grass blades, said warm-air blower being located on the vehicle frame on a side of said mechanical aerator means remote from said water-collecting device.

5. The maintenance vehicle according to claim 1, wherein the water-collecting device includes a suction roller which is a perforated drum-shaped roller with a foam-rubber coating surrounding said suction roller, a netlike textile skin covering said coating, a weight roller operatively engaging a top section of the suction roller and being rotatably arranged axially parallel to said suction roller, and a catching trough arranged in the suction roller below the weight roller with a pipeline leading into a water tank for the purpose of emptying the trough.

6. The maintenance vehicle according to claim 5, wherein the suction roller is rotatably supported on an axle which in turn is supported at each end on a respective leaf spring disposed transversely on the underside of the vehicle frame, the opposite ends of which are pivotally supported on the vehicle frame.

7. The maintenance vehicle according to claim 5, wherein the weight roller extends generally the full length of the suction roller and is rotatably supported at each end on a respective lever pivotally supported on the vehicle.

8. The maintenance vehicle according to claim 6, wherein the stationary catching trough is supported on the axle supporting the suction roller and has an opening extending within the suction roller its entire length and across a width corresponding with an inside diameter of the suction roller.

9. The maintenance vehicle according to claim 8, wherein the opening of the catching trough is in a horizontal alignment above the axis of rotation of the suction roller, and the base of the trough is arranged directly above a lower curvature section of the suction roller.

10. The maintenance vehicle according to claim 1, wherein the water-collecting device includes a water vacuuming device having a suction part oriented directly above the ground surface and includes a water tank which communicates with the suction part and into which the vacuumed-off water is emptied.

11. The maintenance vehicle according to claim 10, wherein the means for adjustably moving the water-collecting device includes a carrier secured on a front end of the vehicle frame and includes means for removably supporting the water-collecting device.

12. The maintenance vehicle according to claim 1, wherein the vehicle frame further includes a driver's cab and four ground engaging wheels.

13. A method for removing water from the surface of a natural grass sports playing field using a maintenance vehicle having at least one water-collecting device and a ground aerator device thereon, comprising the steps of:

a) removing water accumulated on the natural grass playing field by collecting the water in said water-collecting device; and b) followed immediately by aerating and loosening a portion of the ground from which water has just been removed by creating small grooves or rows of openings in the surface of the ground to cause any residual water on the ground to enter the grooves or rows of openings to orient the surface of the water below an upper surface of the ground so that grass blades above the surface of the ground will be free of contact with the residual water to thereby enhance a drying of the grass blades.

* * * * *